US006280251B1

(12) United States Patent
Nishio et al.

(10) Patent No.: US 6,280,251 B1
(45) Date of Patent: Aug. 28, 2001

(54) ELECTRICAL CONNECTOR

(75) Inventors: Atsushi Nishio, Ibaraki; Katsuhiro Hori, Mito, both of (JP)

(73) Assignee: Mitsumi Newtec Co., Ltd. (JP)

( * ) Notice: Subject to any disclaimer, the term of this patent is extended or adjusted under 35 U.S.C. 154(b) by 0 days.

(21) Appl. No.: 09/491,752

(22) Filed: Jan. 27, 2000

(30) Foreign Application Priority Data

Jan. 27, 1999 (JP) ..... 11-018581

(51) Int. Cl.[7] ..... H01R 13/648
(52) U.S. Cl. ..... 439/607
(58) Field of Search ..... 439/607, 608, 439/609, 610

(56) References Cited

U.S. PATENT DOCUMENTS 4,854,895 * 8/1989 Komatsu ..... 439/610
4,875,872 * 10/1989 Tanaka ..... 439/344
6,109,967 * 8/2000 Chiou ..... 439/607

* cited by examiner

*Primary Examiner*—Khiem Nguyen
(74) *Attorney, Agent, or Firm*—Morrison Law Firm

(57) ABSTRACT

A connector, even when miniaturized, can reliably prevent incorrect insertion of the connector plug with respect to the connector socket and that has no risk of breaking the inner insulated housing and the like when an outside force is applied during insertion, the connector including a connector socket 2, having a shield case 4, which is a metal plate bent and formed into a rectangular tube, and an insulating housing 6, which supports a plurality of contact pins 5 and is built into the interior of shield case 4, a connector plug 3, having a plug part 3*a* which is inserted into an insertion opening 11 of connector socket 2; a pair of L-shaped depression parts 16, where both lower corners of shield case 4 are indented towards insertion opening 11.

1 Claim, 4 Drawing Sheets

ELECTRICAL CONNECTOR

BACKGROUND TO THE PRESENT INVENTION

The present invention relates to an electrical connector. In particular, the present invention relates to a connector used in connecting electronic devices such as personal computers and the like.

In recent years, connectors termed universal serial bus (USB) connectors as shown in FIG. 5 have been used in computers. Because of component crowding in small space areas in computers and like devices, the connectors used are sometimes referred to as "small" or "miniature" connectors.

This connector comprises a connector socket 2A, which can be mounted onto a substrate of a printed circuit board 1A and the like, and a connector plug 3A, which is inserted into and connects to connector socket 2A. Connector socket 2A is equipped with a shield case 4A, which is constructed by bending and shaping a metal plate into a tube of rectangular section.

An insulated housing 6A, which supports four contact pins 5A side by side in the cross direction, is built into the inside of shield case 4A. The middle section of contact pin 5A is attached to the base of insulated housing 6A. Contact pin 5A has an external connection end 5*a*, which leads out from one end of shield case 4A. An end support part 6*b* is formed integrally on the top half of base 6*a* of insulated housing 6A. End support part 6*b* has approximately half of the vertical thickness of shield case 4A. A contact end 5*b* of contact pin 5A is supported by the lower surface of end support part 6*b*.

Connector plug 3A, which connects to connector socket 2A, has a shield case 7A, which is a tube of rectangular section. Shield case 7A is insertable inside shield case 4A. A cavity 8A, which receives end support part 6*b*, is formed in the interior of a plug shield 7*a* of shield case 7A. A contact end 10*a* of a contacter 10A, which is supported by an end support part 9*a* of an insulated housing 9A, is positioned directly below cavity 8A.

In other words, in the "small" connector of the prior art as described above, if there is an attempt to insert connector plug 3A into connector socket 2A when connector plug 3A is vertically inverted, end support part 6*b* of insulated housing 6A does not match up with the cavity in connector plug 3A. Because the end of end support part 9*a* of insulated housing 9 bumps into external contact end 5*a*, incorrect insertions are prevented.

However, with this prior art, with small connector sockets in which the vertical width of connector socket 2A is reduced and the thickness of end support part 6*b* and end support part 9*a* made thin, mechanical strength can be inadequate, and when a strong force acts between both of these parts during insertion, they can break easily or become deformed.

In addition, with these small connectors, incorrect insertions are also prevented with a construction where corner parts of shield case 4 and shield case 7A, which are formed as rectangular tubes, are cut at an angle so that there is vertical asymmetry. But because of errors in the making of the cut corner parts, incorrect insertions are not always prevented effectively.

OBJECT AND SUMMARY OF THE PRESENT INVENTION

Upon considering the problems of the small connector of the prior art as described above, the object of the present invention is to obtain a connector that, even when miniaturized, can reliably prevent incorrect insertion of the connector plug with respect to the connector socket. There would be no danger of breaking the inner insulated housing and the like when an outside force is applied during insertion.

In order to achieve this objective, the present invention proposes a small connector, comprising: a connector socket, having a shield case, which is a metal plate bent and formed into a rectangular tube, and an insulating housing, which supports a plurality of contact pins and is built into the interior of the shield case; a connector plug, having a plug part which is inserted into an insertion opening of the connector socket; a pair of L-shaped depression parts, where both lower corners of the shield case are indented towards the insertion opening.

In preferred embodiments of the invention, the plug part has a pair of depressions formed at a part that corresponds to the L-shaped depression parts; stopper surfaces, which can join up against the L-shaped depression parts, are positioned on the inner ends of the depressions and the plug part comprises a plug shield, which is a metal plate bent and shaped into a rectangular tube; the pair of depressions is formed on the outer surface of L-shaped depressed deformation parts in which both lower corners of the plug shield are indented towards the interior; the stopper surfaces are surfaces of kerfs that cut and offset corresponding L-shaped depressed deformation parts.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Referring to FIGS. 1 through 4, an embodiment of the present invention is described in detail.

Figure 1:
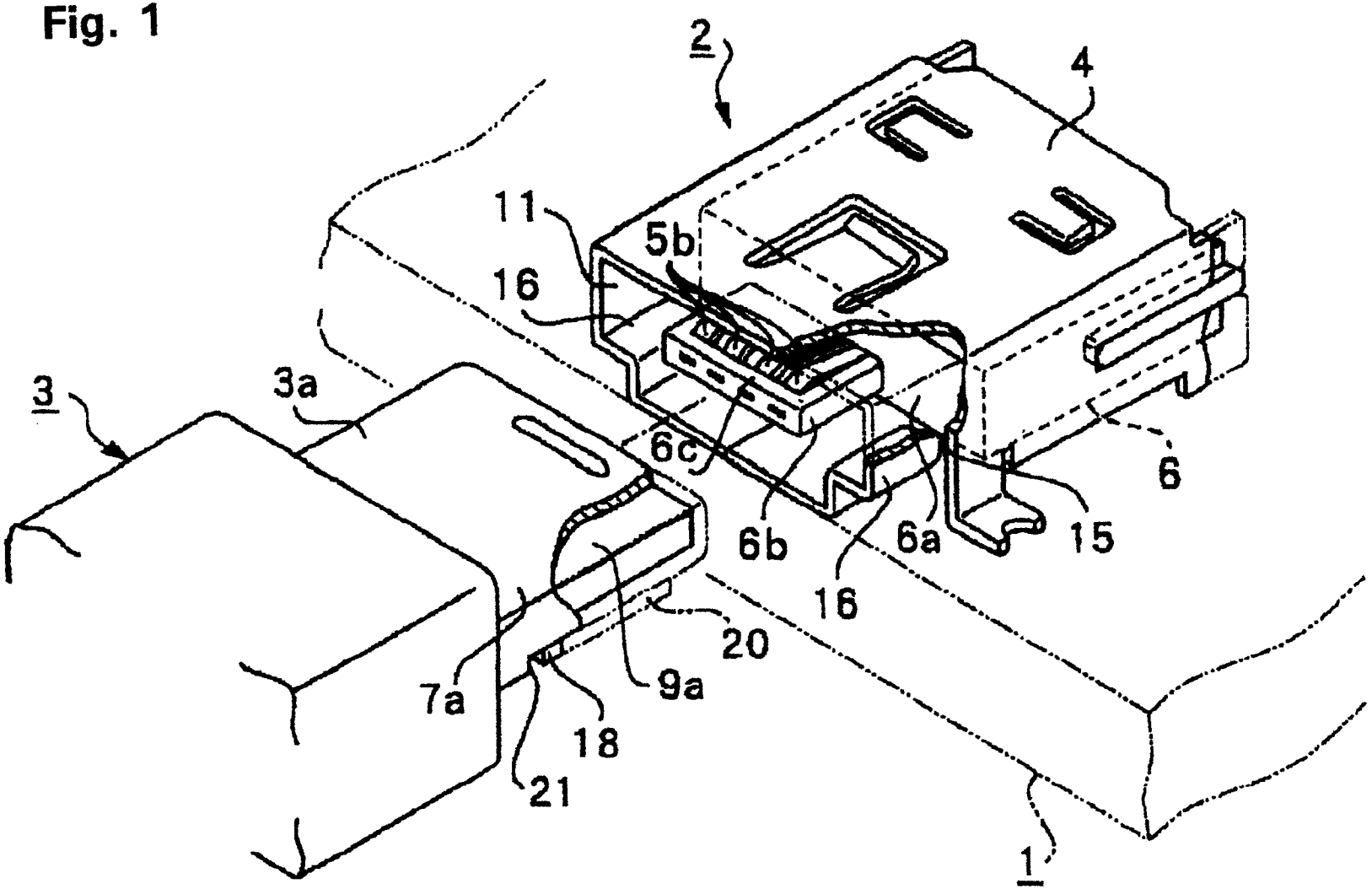
FIG. 1 is an exploded perspective drawing of the connector of the present invention with a section removed.
Figure 2:
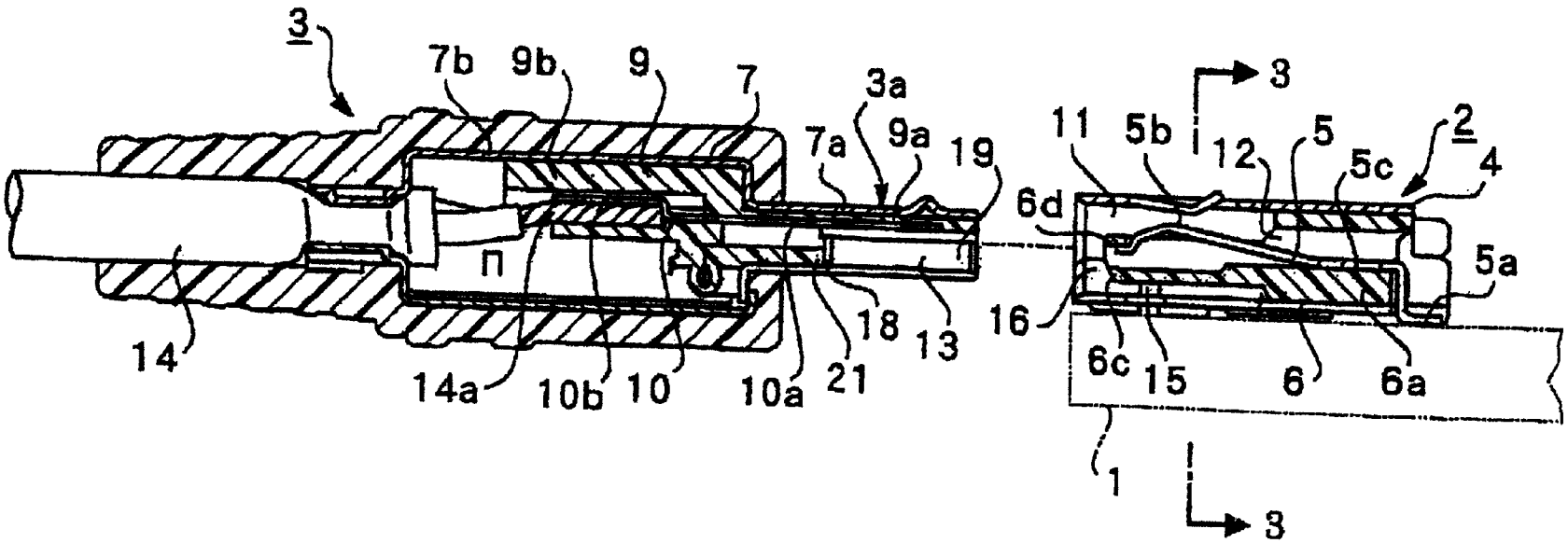
FIG. 2 is a whole cross-section drawing of the same connector, the connector plug not being inserted in the connector socket.
Figure 3:
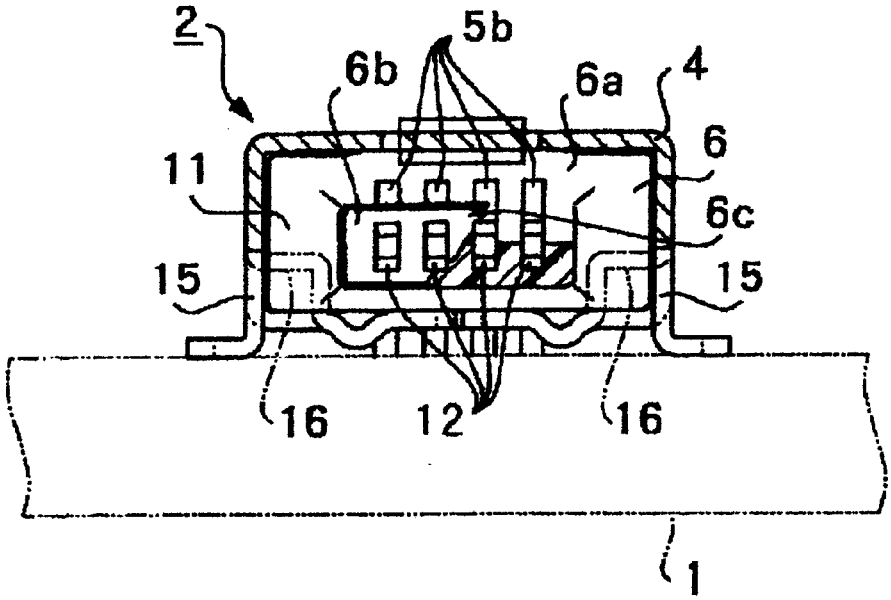
FIG. 3 is a view taken along line 3—3 of FIG. 2.
Figure 4:
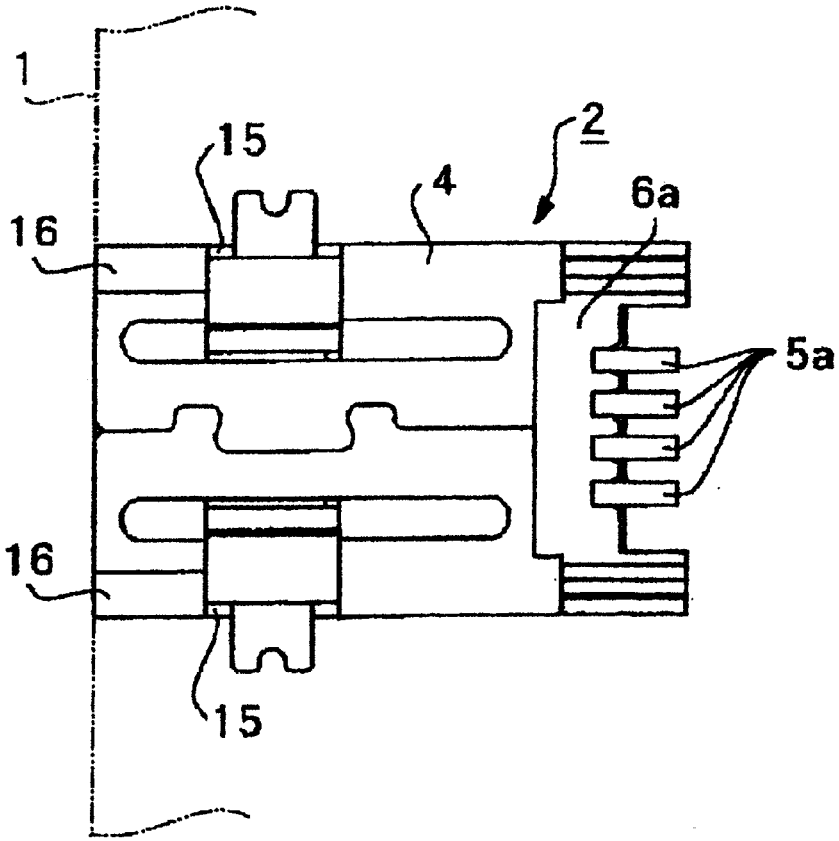
FIG. 4 is a bottom view of the connector socket.
Figure 5:
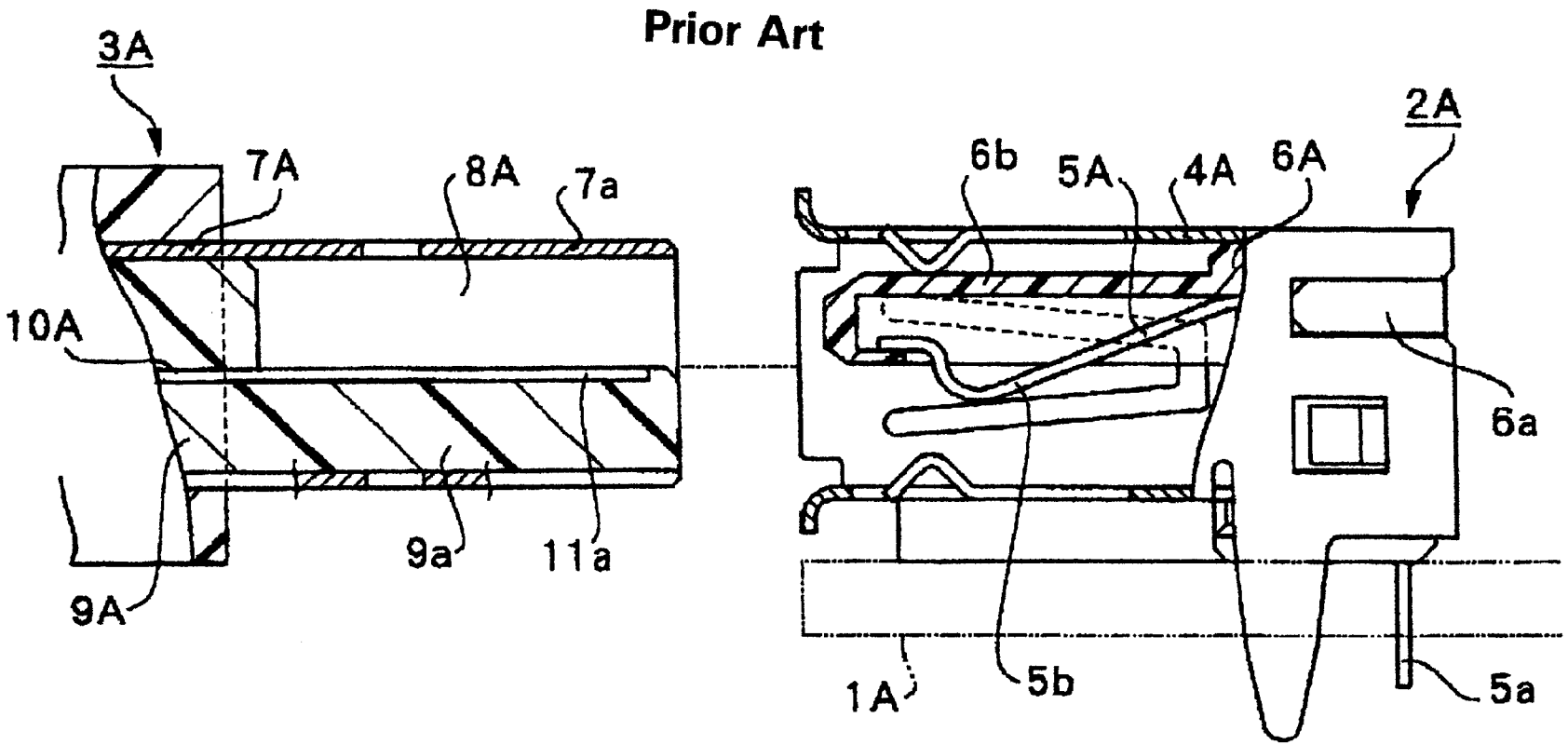
FIG. 5 is a longitudinal side view partly in section of a USB connector of the prior art.

Referring to FIGS. 1 and 2, a "small" connector of the present invention is shown. The small connector comprises a connector socket 2, which is mounted onto the surface of a printed circuit board 1, and a connector plug 3, which has a plug part 3*a* which can be inserted into an insertion opening 11 of connector socket 2.

Connector socket 2 has a shield case 4, which is a metal plate bent and deformed into a rectangular section tube so that one end forms insertion opening 11 for reception of plug part 3*a*. An insulated housing 6 of a molded resin is positioned inside shield case 4. Insulating housing 6 supports four contact pins 5 aligned in the cross direction of shield case 4.

Insulated housing 6 is built into shield case 4 from the right end of shield case 4. Insulated housing 6 has a base 6*a*, which has approximately the same cross-sectional dimensions as the inner cross sectional area of shield case 4. Inside shield case 4, there is an integrally formed end support part 6*b*, which extends as a cantilever on the left side of base 6*a*.

Inside insulated housing 6, four attachment grooves 12, which are aligned in parallel in the cross direction of shield case 4, are formed in the longitudinal direction of shield case 4. Each of contact pins 5, which are made of spring-like metal, is positioned in each of attachment grooves 12. The mid-section of each contact pin 5 is attached inside corresponding attachment groove 12. However, external contact end 5*a*, which is bent and processed into an "L" shape, leads out to the exterior from the right end of shield case 4. External contact end 5*a* is soldered onto the conductor layer of printed circuit board 1 on which connector socket 2 is mounted.

From attachment groove 12, which is open above, curved contact end 5*b* of each contact pin 5 is extends along and opposed to the upper surface of end support part 6*b*. However, the end of contact end 5*b* engages with engaging part 6*c*, which is formed integrally on the end of end support part 6*b*. By this engagement, the unrestrained releasing of external contact end 5*a* from corresponding attachment groove 12 is controlled.

Connector plug 3, which is covered by an external covering of an insulated resin, is equipped with a plug part 3*a*, which can be inserted into insertion opening 11. Plug part 3*a* has a plug shield 7*a* of shield case 7. Plug shield 7*a* has outer shape dimensions that correspond to the inner dimensions of shield case 4 of connector socket 2. As in shield case 4, plug shield 7*a* is constructed by bending and deforming a metal plate into a rectangular tube. End support part 9*a* of insulated housing 9 supports four contacters 10, which have a corresponding relationship with contact pins 5, and is positioned inside of plug shield 7*a*.

Contact ends 10*a* of each of contacters 10 are exposed at the lower surface of end support part 9*a* of insulated housing 9, which extends along the top wall of plug shield 7*a*. A cavity 13 for receiving end support part 6*b* of insulated housing 6 is formed between the lower surface of end support part 9*a* and the upper surface of the bottom wall of plug shield 7*a*.

When plug part 3*a* of connector plug 3 is inserted into insertion opening 11 of connector socket 2, end support part 6*b* of insulated housing 6 and end support 9*a* of insulated housing 9 become proximate and are opposite each other in the vertical direction. As a result, contact end 10*a* of each of contacters 10 comes in contact with contact end 5*b* of the corresponding contact pin 5.

Shield case 7 has a cord shield 7*b*, which is formed integrally with plug shield 7*a* and has a large volume. A cord connecting part 9*b*, which is connected to end support part 9*a*, is positioned inside cord shield 7*b*. Cord connecting end 10*b* of each of contacters 10 is positioned at cord connecting part 9*b*. Cord connecting end 10*b* is each attached by soldering to core 14*a* of connecting cord 14, which leads out from the end of cord shield 7*b*.

In order to prevent incorrect insertion of connector plug 3 with respect to connector socket 2, kerfs 15 are formed on both of the lower corners which face the left end of shield case 4 of connector socket 2. From kerfs 15, both corners are indented towards insertion opening 11 to form L-shaped depression parts 16.

Kerfs 18 also are formed on both corners at the end of plug shield 7*a* of connector plug 3. From kerfs 18, these corners are indented towards cavity 13, and L-shaped depressed deformation parts 19 are bent and formed in companion alignment correspondence with L-shaped depression parts 16. Depressions 20, which can clear L-depression parts 16 of shield case 4, are formed by the outside surfaces of L-shaped depression deformation parts 19.

In addition, stopper surfaces 21, constructed from the surfaces of kerfs 18, are formed on plug shield 7*a*. Stopper surfaces 21 face the end surfaces of L-shaped depression parts 16 of shield case 4. Therefore, when plug 3*a* of connector plug 3 is inserted into insertion opening 11 of connector socket 2, if it is inserted approximately completely, stopper surfaces 21 of shield case 7 joins up against the end surface of L-shaped depression parts 16. A stable insertion position for connector plug 3 with respect to connector socket 2 is achieved.

Because the embodiment shown has the above construction, incorrect insertion of connector plug 3 with respect to connector socket 2 can be reliably prevented. If there is an attempt to insert plug 3*a* of connector plug 3 into insertion opening 11 of connector socket 2 when connector plug 3 is vertically inverted, the end corners of plug shield 7*a* of connector plug 3 hit L-shaped depression parts 16 of connector socket 2. As a result, plug 3*a* of connector plug 3 cannot be inserted into insertion opening 11 of connector socket 2. As a result, a vertically-inverted, incorrect insertion is prevented.

In this case, because L-shaped depression parts 16 jut out to a great extent towards the interior of insertion opening 11, even with a small connector, incorrect insertions are reliably prevented. In addition, because L-shaped depression parts 16 are positioned at the entrance of insertion opening 11, damage, because of undue outside force, to contact pins 5 or insulated housing 6 within insertion opening 11 is prevented.

In the example shown, plug 3*a* of connector plug 3 is guided into insertion opening 11 of connector socket 2 by rectangular tube shield case 4 and rectangular tube plug shield 7*a* of connector plug 3. Each of these rectangular tubes is constructed from metal plates. As a result, even with repeated insertions and removals, an adequate durability can be maintained.

As is clear from the above description, in order to prevent a vertically-inverted, incorrect insertion of the connector plug, an L-shaped depression part is integrally formed on the lower corners of the opening of the shield case of the connector socket. As a result, even with an extremely small connector, the inner contact pins and the like are adequately protected, and incorrect insertions are reliably prevented. Furthermore, L-shaped depression parts, depressions, and stopper surfaces are constructed from the shield case and the connector plug shield case, which are constructed into rectangular tubes from metal plates. As a result, a construction with adequate durability against insertions and removals is created.

Having described preferred embodiments of the present invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrical connector, comprising:

a connector socket including a metal shield case of rectangular tubular cross section, and an insulated housing disposed in the shield case, said insulated housing supporting a plurality of contact pins;

a connector plug, said connector plug including a plug part insertable in an insertion opening of said connector socket;

each of two opposed lower corners of said shield case being indented towards said insertion opening to define a pair of L-shaped depression parts;

said plug part has a pair of depressions formed at a part that is in companion aligned correspondence with the L-shaped depression parts of said connector socket shield case;

stopper surfaces on said plug part at inner ends of said depressions which can engage end surfaces of said, L-shaped depression parts when said plug part is fully inserted into said socket opening;

said plug part includes a metal shield case of rectangular tubular cross section;

said pair of depressions being formed on an outer surface of the L-shaped depression deformation parts at which both lower corners of said metal shield are indented towards the interior; and said stopper surfaces being surfaces of kerfs cut and offset in corresponding said L-shaped depressed deformation parts on said plug part.

* * * * *